US008484854B2

(12) United States Patent
Ho

(10) Patent No.: US 8,484,854 B2
(45) Date of Patent: Jul. 16, 2013

(54) BLADE-SWITCHABLE UTILITY KNIFE

(76) Inventor: Chun-Feng Ho, Taichung (TW)

( * ) Notice: Subject to any disclaimer, the term of this patent is extended or adjusted under 35 U.S.C. 154(b) by 211 days.

(21) Appl. No.: 13/161,405

(22) Filed: Jun. 15, 2011

(65) Prior Publication Data

US 2011/0308090 A1 Dec. 22, 2011

(30) Foreign Application Priority Data

Jun. 18, 2010 (TW) ..... 99211662 U

(51) Int. Cl.
*B26B 5/00* (2006.01)
*B26B 1/08* (2006.01)

(52) U.S. Cl.
USPC ..... 30/152; 30/162; 30/335

(58) Field of Classification Search
USPC ..... 30/335, 51, 62, 74–75, 143, 152, 30/156, 162; 7/158–163, 118
See application file for complete search history.

(56) References Cited

U.S. PATENT DOCUMENTS

| | | | | |
|---|---|---|---|---|
| 2,789,613 | A * | 4/1957 | Corsaw | 206/37.2 |
| 2,821,724 | A * | 2/1958 | Wurgaft | 7/167 |
| 3,660,896 | A * | 5/1972 | Umholtz | 30/162 |
| 4,005,525 | A * | 2/1977 | Gringer | 30/125 |
| 5,337,481 | A * | 8/1994 | Mears | 30/162 |
| 7,533,467 | B2 * | 5/2009 | Fossella | 30/162 |
| 8,322,531 | B2 * | 12/2012 | Miller et al. | 206/553 |
| 2005/0193567 | A1 * | 9/2005 | Ho | 30/162 |
| 2007/0240314 | A1 * | 10/2007 | Ireland | 30/152 |
| 2009/0106909 | A1 * | 4/2009 | Tyers | 7/118 |
| 2009/0199408 | A1 * | 8/2009 | Zeng | 30/152 |
| 2009/0223063 | A1 * | 9/2009 | Hallquist et al. | 30/162 |
| 2010/0126024 | A1 * | 5/2010 | Price | 30/162 |
| 2010/0281696 | A1 * | 11/2010 | Hao et al. | 30/152 |
| 2011/0232104 | A1 * | 9/2011 | Ho | 30/162 |
| 2012/0174412 | A1 * | 7/2012 | Ho | 30/152 |

* cited by examiner

*Primary Examiner* — Stephen Choi
*Assistant Examiner* — Fernando Ayala
(74) *Attorney, Agent, or Firm* — Cheng-Ju Chiang

(57) ABSTRACT

A blade-switchable utility knife of the present invention comprises a housing, a blade slider, a slide actuator, a switch actuator, a pair of blades and a pair of restoring elements. By manipulating the switch actuator, one of the pair of blades is capable of moving together with the blade slider. Accordingly, the present invention has advantages and effects of quick switch of the blades for use and convenient carrying.

4 Claims, 10 Drawing Sheets

BLADE-SWITCHABLE UTILITY KNIFE

BACKGROUND OF THE INVENTION

1. Field of the Invention

The present invention relates to a switchable utility knife, and particularly to a blade-switchable utility knife having advantages of quickly switching blades for use and carrying conveniently, etc.

2. Related Art

Conventional utility knifes generally are designed to have a blade fixed to a blade sliding holder so as to allow the blade to be extendable out of a shell of the utility knife or retractable therein via moving of the blade sliding holder.

Unfortunately, conventional utility knifes can only be equipped with one blade for use. When the blade becomes worn out and dull in use or different blades are in need, it is necessary to replace the original blade with another blade by detaching the original blade from the blade sliding holder and replacing with another blade. It is rather inconvenient for use.

Furthermore, it is rather inconvenient and time-consuming to replace a blade in the abovementioned way when continuously and alternately using different types of blades is necessary for particular work content. Generally speaking, under such circumstances, two or more utility knifes are prepared to perform such work content for the sake of saving time. However, such working way further causes problems of inconvenient carrying and higher cost, etc.

Hence it is imperative to invent an improved product to overcome the above-mentioned drawbacks and problems.

SUMMARY OF THE INVENTION

Accordingly, an object of the present invention is to provide a blade-switchable utility knife having advantages and effects of quick switch of blades for use and convenient carrying, etc. The present invention can solve drawbacks of inconvenient use of conventional utility knifes equipped with only one blade for use.

In order to solve the above mentioned problems, the present invention provides a blade-switchable utility knife comprising:

a housing defining an internal space therein, an opening, a sliding slot, a switch groove, a pair of first limit portions and a pair of second limit portions;

a blade slider received in the internal space of the housing to be slidably moving backwards and forwards within the internal space and to move to at least a blade retraction position and a blade protrusion position, the blade slider having a first blade compartment and a second blade compartment, a fixing bulge formed in each of the first and second blade compartments;

a slide actuator fixedly disposed on the blade slider, and installed and slidably movable in the sliding slot;

a switch actuator slidably installed in the switch groove and comprising a push portion and a follower portion, the push portion capable of being pushed to at least a first switch position and a second switch position;

a pair of blades respectively disposed in the first and second blade compartments, each blade of the pair of blades having first and second concave portions and being capable of being placed in an operative position and a non-operative position; and a pair of restoring elements used to respectively restore the pair of blades back to the operative positions thereof;

wherein when the push portion of the switch actuator is located in the first switch position, the follower portion pushes against the blade disposed in the first blade compartment to move to the non-operative position thereof so as to allow the first and second concave portions of the blade in the first blade compartment to respectively engage with the pair of first limit portions, and the blade disposed in the second blade compartment remains in the operative position thereof with the first concave portion thereof engaging with the fixing bulge of the second blade compartment whereby the blade slider is capable of advancing forward from the blade retraction position to the blade protrusion position by pushing the slide actuator so as to simultaneously move the blade in the second blade compartment extending out of the opening, and when the push portion of the switch actuator is located in the second switch position, the follower portion pushes against the blade received in the second blade compartment to the non-operative position thereof so as to allow the first and second concave portions of the blade in the second blade compartment to respectively engage with the pair of second limit portions, and the blade in the first blade compartment remains in the operative position thereof with the first concave portion thereof engaging with the fixing bulge of the first blade compartment whereby the blade slider is capable of advancing forward from the blade retraction position to the blade protrusion position by pushing the slide actuator so as to simultaneously move the blade in the first blade compartment extending out of the opening.

DESCRIPTION OF THE PREFERRED EMBODIMENTS

Figure 1:
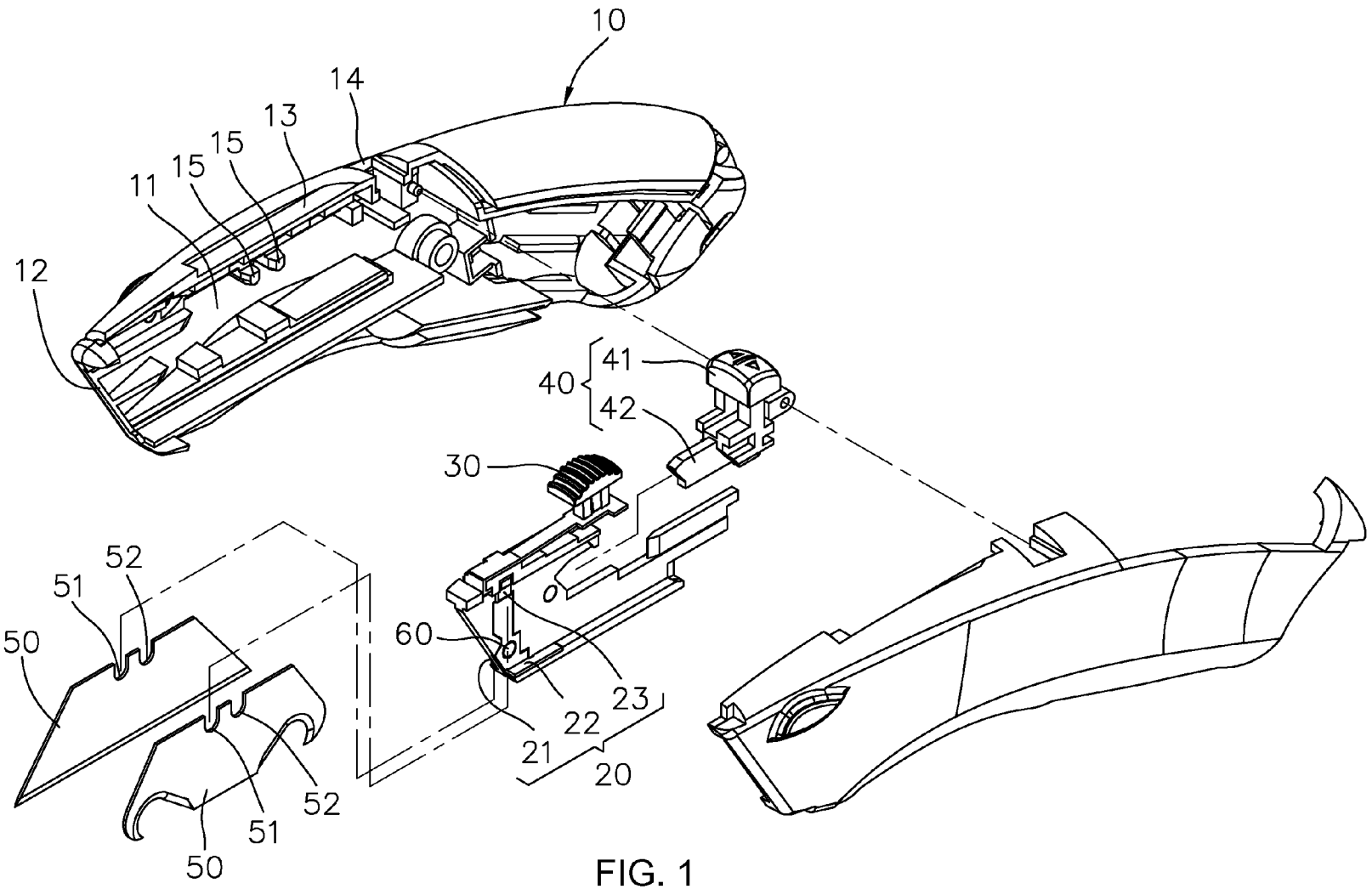
FIG. 1 is a schematic exploded perspective view of a blade-switchable utility knife of the present invention.
Figure 2:
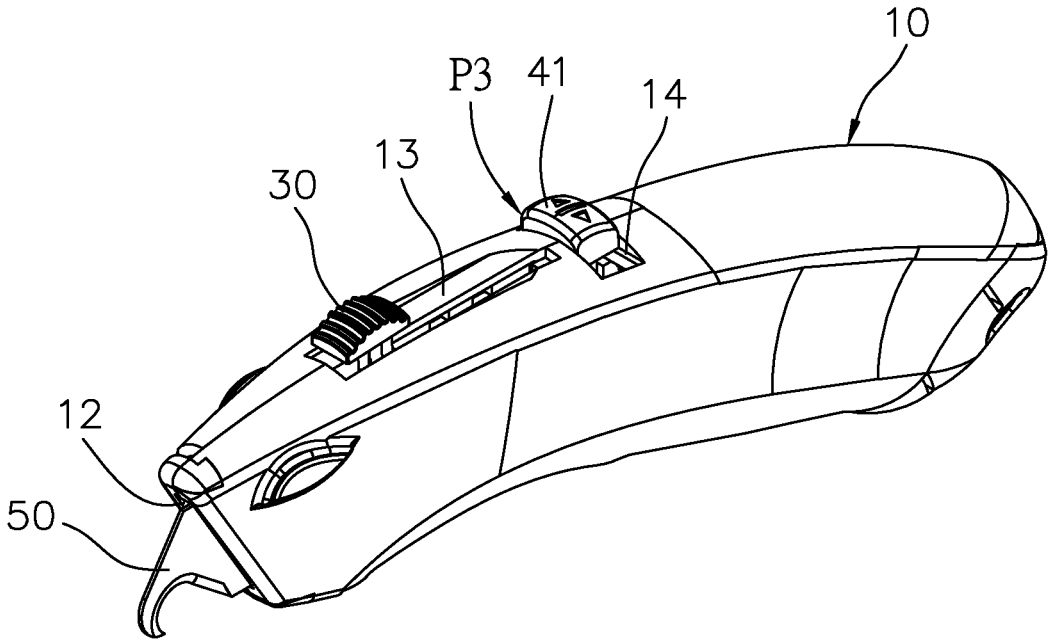
FIG. 2 is an assembled perspective view of FIG. 1.
Figure 3:
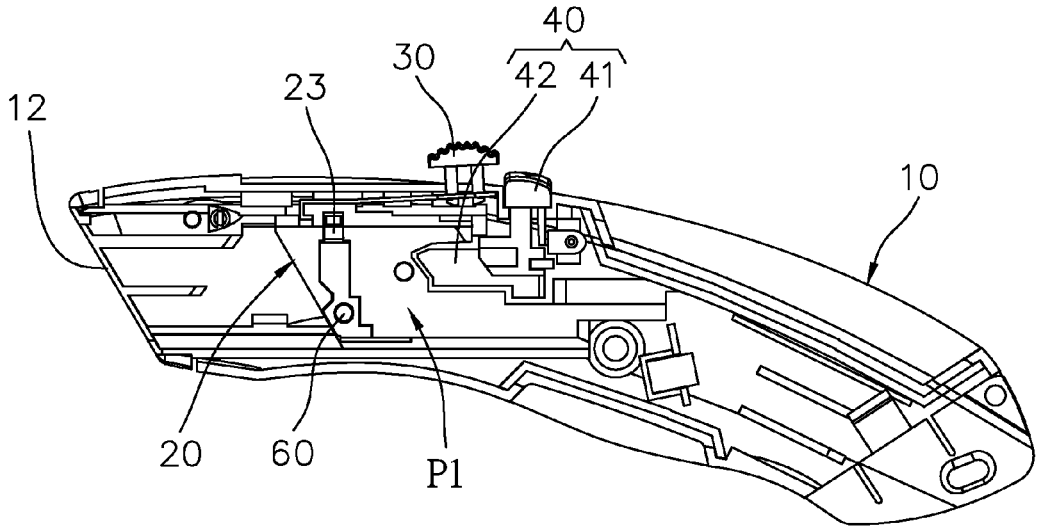
FIG. 3 is a schematic view showing a blade slider of the present invention in a first moving position thereof inside a housing of the present invention.
Figure 4:
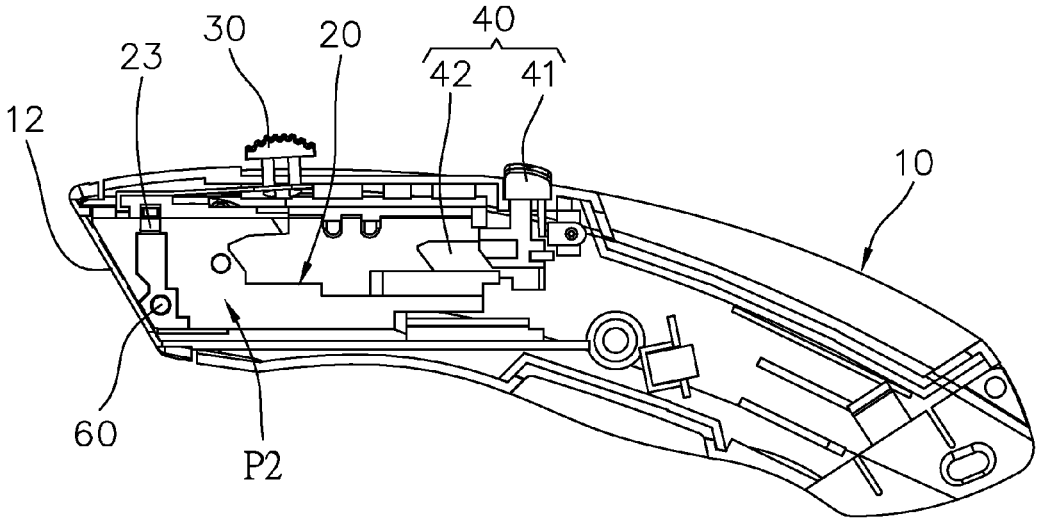
FIG. 4 is a schematic view showing the blade slider of the present invention in a second moving position thereof inside the housing.

Referring to FIG. 1 to FIG. 6B, a blade-switchable utility knife of the present invention of the present invention comprises a housing 10 defining an internal space 11, an opening 12, a sliding slot 13, a switch groove 14, a pair of first limit portions 15 and a pair of second limit portions 16 therein.

A blade slider 20 is received in the internal space 11 of the housing 10 to be slidably moving backwards and forwards within the internal space 11. The blade slider 20 can be at least moved to a blade retraction (first moving) position P1 and a blade protrusion (second moving) position P2. The blade slider 20 comprises a first blade compartment 21 and a second blade compartment 22, and a fixing bulge 23 is formed in each of the first and second blade compartments 21, 22. A width of the opening 12 is equal to (or slightly larger than) a width of the blade slider 20 plus a width of a pair of blades 50.

A slide actuator 30 is fixedly disposed on the blade slider 20 and is installed in the sliding slot 13 to be slidably movable in the sliding slot 13.

A switch actuator 40 is installed in the switch groove 14 to be slidably movable in the switch groove 14, and comprises a push portion 41 and a follower portion 42. The push portion 41 is capable of being pushed to at least a first switch position P3 and a second switch position P4.

The pair of blades 50 is respectively disposed in the first and second blade compartments 21, 22. Each blade of the pair of blades 50 comprises a first concave portion 51 and a second concave portion 52. Each blade is capable of being placed in at least an operative position P5 and a non-operative position P6. In this embodiment, the pair of blades 50 is made of magnetic material.

A pair of restoring elements 60 is used to restore the blades 50 back to their respective operative positions P5. The pair of restoring elements 60 in this embodiment is magnetic elements (such as magnets, which are able to apply magnetic attraction on the blades 50 of the present invention). The pair of restoring elements 60 is disposed respectively in the first and second blade compartments 21, 22.

In this manner, when the push portion 41 of the switch actuator 40 is located in the first switch position P3, the follower portion 42 accordingly pushes against the blade 50 received in the first blade compartment 21 to move to the non-operative position P6 thereof so as to allow the first and second concave portions 51, 52 of the blade 50 to respectively engage with the pair of first limit portions 15. Meanwhile, the blade 50 received in the second blade compartment 22 remains in the operative position P5 thereof with the first concave portion 51 thereof engaging with the fixing bulge 23 of the second blade compartment 22. At this moment, the entire blade slider 20 is capable of advancing forward from the blade retraction position P1 to the blade protrusion position P2 by pushing the slide actuator 30 so as to move the blade 50 in the second blade compartment 22 simultaneously to extend the blade 50 out of the opening 12. Alternatively, when the push portion 41 of the switch actuator 40 is located in the second switch position P4, the follower portion 42 accordingly pushes against the blade 50 received in the second blade compartment 22 to move to the non-operative position P6 thereof so as to allow the first and second concave portions 51, 52 of the blade 50 in the second blade compartment 22 to respectively engage with the pair of second limit portions 16. Meanwhile, the blade 50 received in the first blade compartment 21 remains in the operative position P5 thereof with the first concave portion 51 thereof engaging with the fixing bulge 23 of the first blade compartment 21. At this moment, the entire blade slider 20 is capable of advancing forward from the blade retraction position P1 to the blade protrusion position P2 by pushing the slide actuator 30 so as to move the blade 50 in the first blade compartment 21 simultaneously to extend the blade 50 out of the opening 12.

Figure 5:
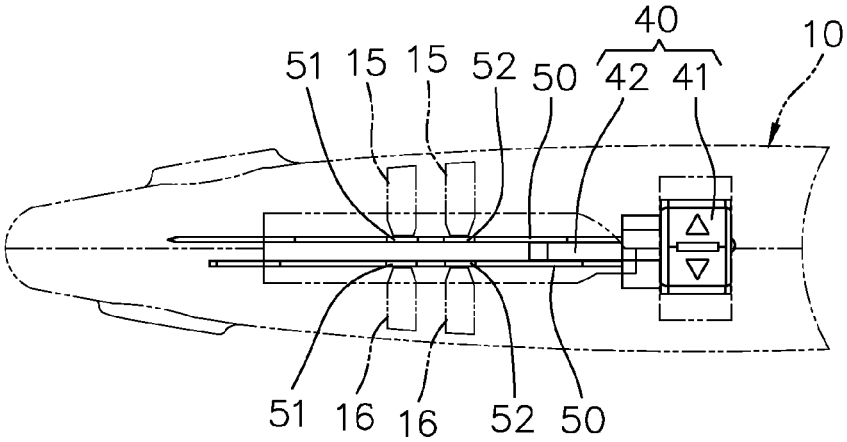
FIG. 5 is a schematic partial top plan view of the present invention.
Figure 6A:
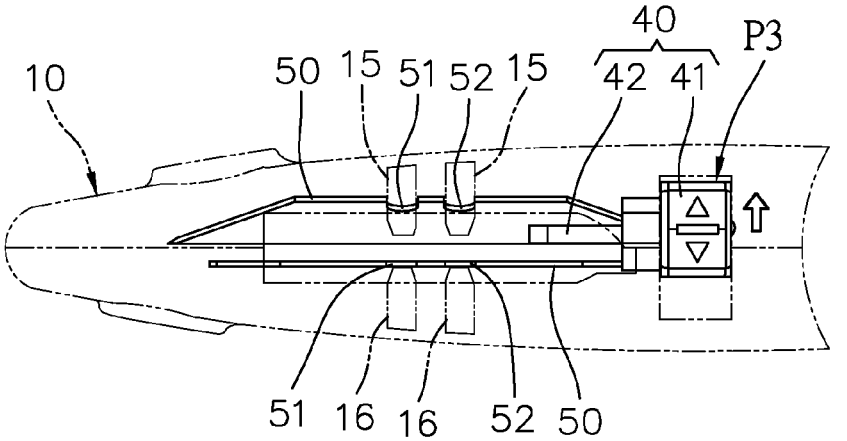
FIG. 6A is a schematic partial top plan view showing a switch actuator of the present invention in a first switch position thereof.
Figure 6B:
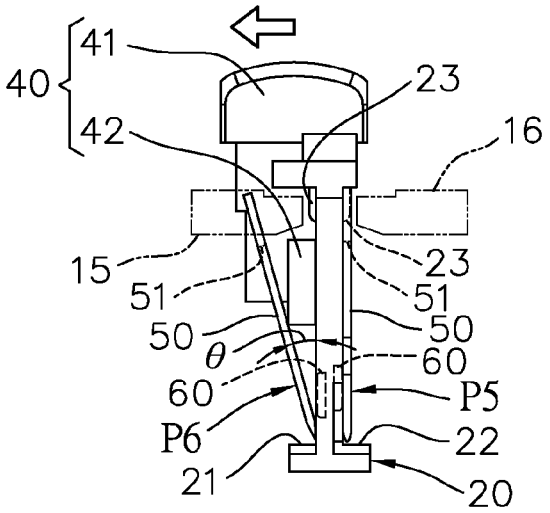
FIG. 6B is a schematic partial front elevational view of FIG. 6A.
Figure 7A:
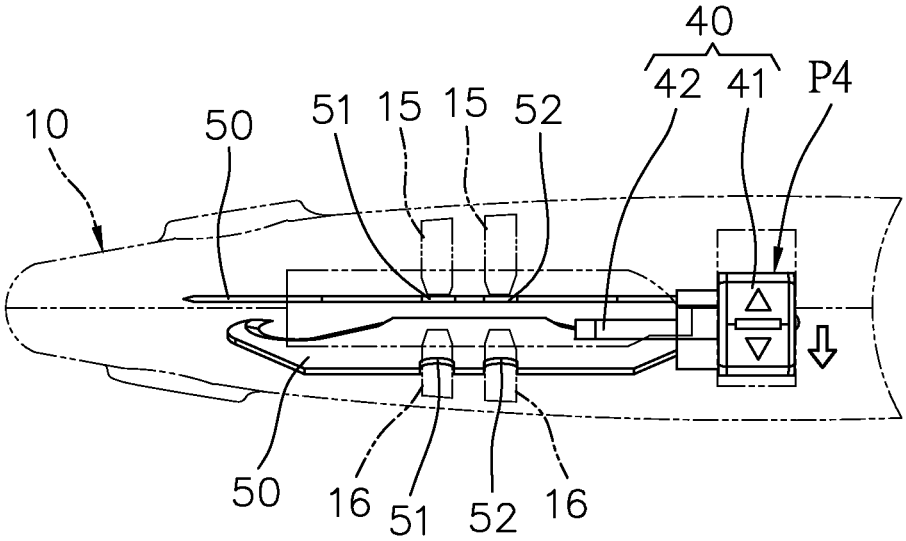
FIG. 7A is a schematic partial top plan view showing the switch actuator of the present invention in a second switch position thereof.
Figure 7B:
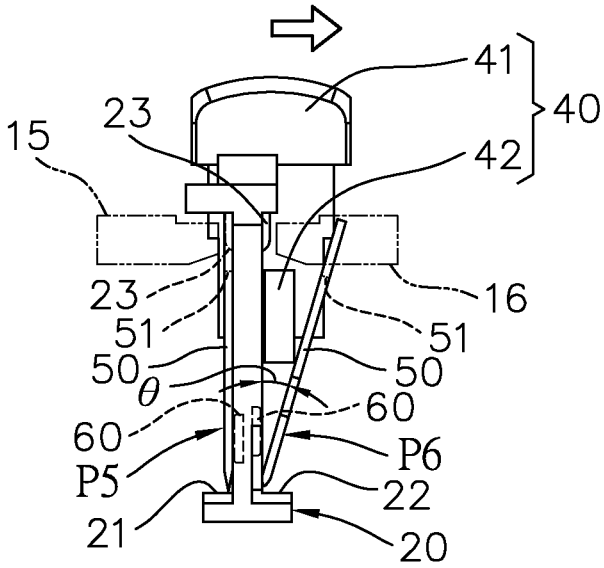
FIG. 7B is a schematic partial front elevational view of FIG. 7A.

As shown in FIG. 5, the pairs of first and second limit portions 15, 16 are respectively disposed at two opposite sides of the housing 10. As shown in FIGS. 6A and 6B, when the push portion 41 of the switch actuator 40 moves to the first switch position P3, the follower portion 42 pushes against the blade 50 received in the first blade compartment 21 to incline at a predetermined angle θ relative to the blade slider 20, and the first and second concave portions 51, 52 respectively engage with the pair of the first limit portions 15. Likewise, as show in FIGS. 7A and 7B, when the push portion 41 of the switch actuator 40 moves to the second switch position P4, the follower portion 42 pushes against the blade 50 received in the second blade compartment 22 to incline at a predetermined angle of θ relative to the blade slider 20, and the first and second concave portions 51, 52 respectively engage with the pair of the second limit portions 16. Accordingly, without push of the follower portion 42, the blade 50 received in the first blade compartment 21 restores back to the operative position P5 thereof from the non-operative position P6 thereof via magnetic attraction of one of the pair of the restoring elements 60. Vice versa, when the push portion 41 of the switch actuator 40 switches again from the second switch position P4 to the first switch position P3, the blade 50 in the second blade compartment 22 restores back to the operative position P5 thereof from the non-operative position P6 thereof via magnetic attraction of another of the pair of the restoring elements 60.

Accordingly, the present invention utilizes position switch of the push portion 41 of the switch actuator 40 to limit the blade 50 either in the first blade compartment 21 or the second blade compartment 22 onto either one of the pairs of the first and second limit portions 15, 16. When the slide actuator 30 is pushed to move the blade slider 20 from the blade retraction position P1 to the blade protrusion position P2, the blade 50 engaged and limited by either one of the pairs of the first and second limit portions 15, 16 is unable to move together with the blade slider 20 while the blade 50 engaged with the fixing bulge 23 is able to move together with the blade slider 20 and protrudes out of the opening 12.

Figure 8A:
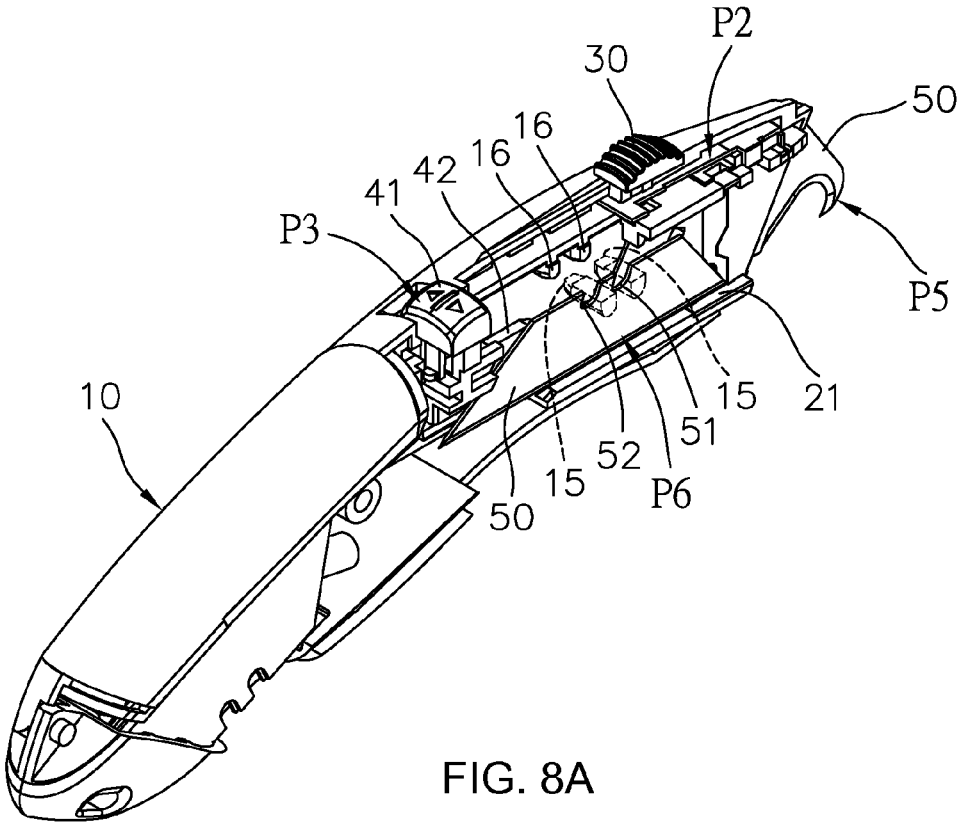
FIG. 8A is a schematic perspective view showing a first blade of the present invention protruding out of the housing for use when the switch actuator is in the first switch position thereof.
Figure 8B:
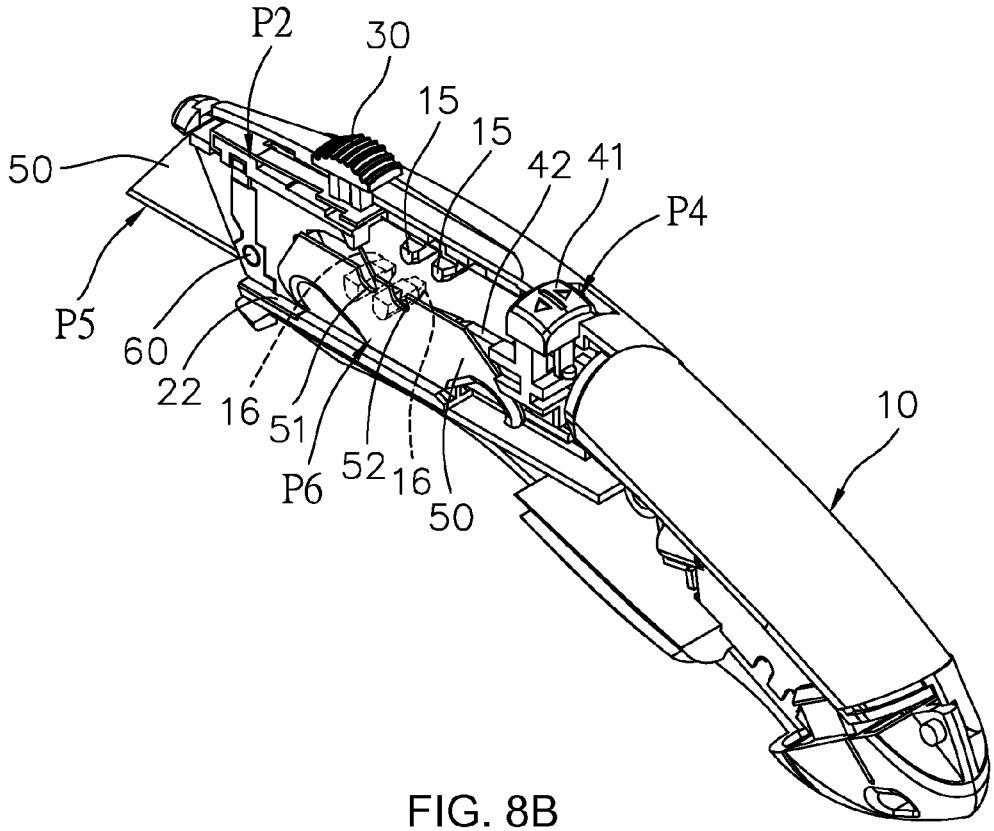
FIG. 8B is a schematic perspective view showing a second blade of the present invention protruding out of the housing for use when the switch actuator is in the second switch position thereof.

Referring to FIG. 8A, when the push portion 41 is located in the first switch position P3, the blade 50 in the first blade compartment 21 is limited by the pair of the first limit portions 15. In such circumstances, pushing the slide actuator 30 forwards enables the blade 50 in the second blade compartment 22 to protrude out of the opening 12. Referring to FIG. 8B, when the push portion 14 is located in the second switch position P4, the blade 50 in the second blade compartment 22 is limited by the pair of the first limit portions 16. In such circumstances, pushing the slide actuator 30 forwards enables the blade 50 in the first blade compartment 21 to protrude out of the opening 12.

As understood from the above explanations, the first and second blade compartments 21, 22 of the present invention can be placed with the two blades 50, respectively. The two blades 50 can be of different standards, functions, or shapes.

Users can switch the blades 50 at any time during working processes. Certainly, the first and second blade compartments 21, 22 can be placed with two blades of the same standard. When one of the blades is damaged, users can directly switch to another blade and continue working.

Figure 9:
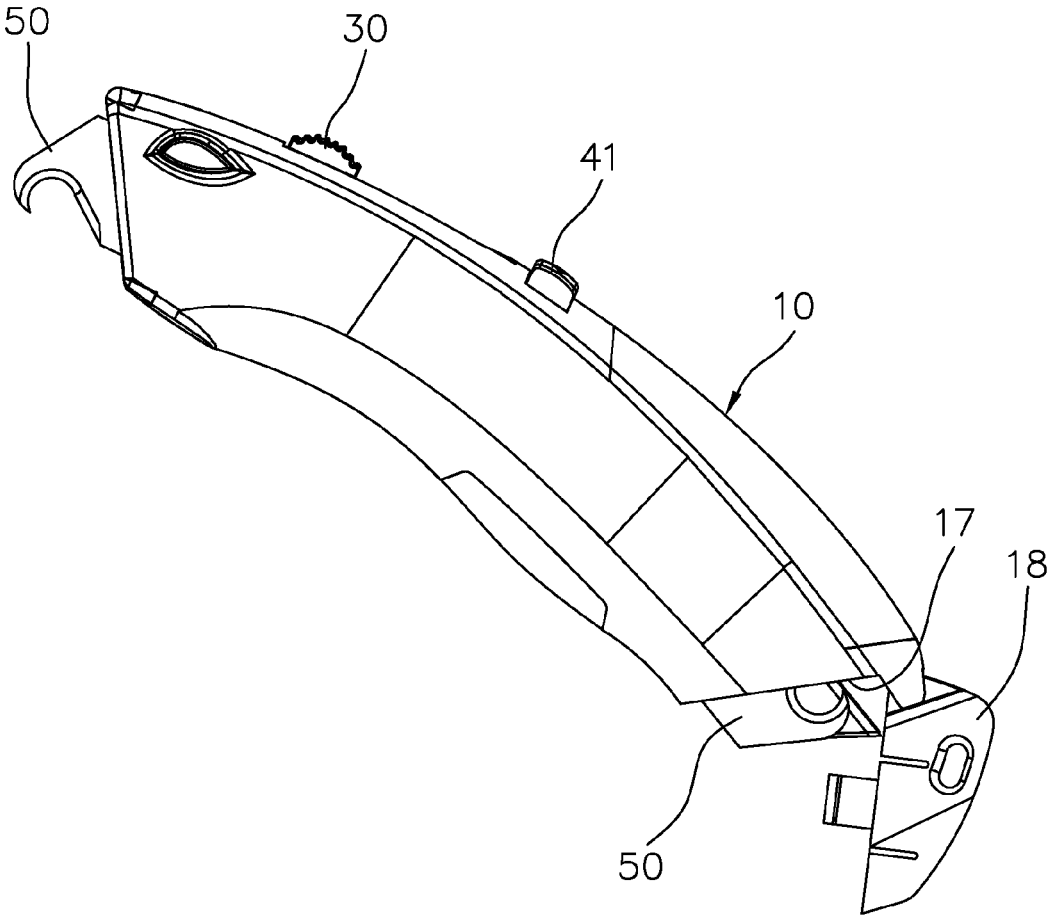
FIG. 9 is a schematic side view of the blade-switchable utility knife showing a storage space of the present invention.

Referring to FIG. 9, the housing 10 of the present invention further comprises a storage space 17 and a movable cover 18. The storage space 17 can store a plurality of the spare blades 50 therein, and the movable cover 18 is disposed at an opening of the storage space 17 for opening or closing the storage space 17.

Figure 10A:
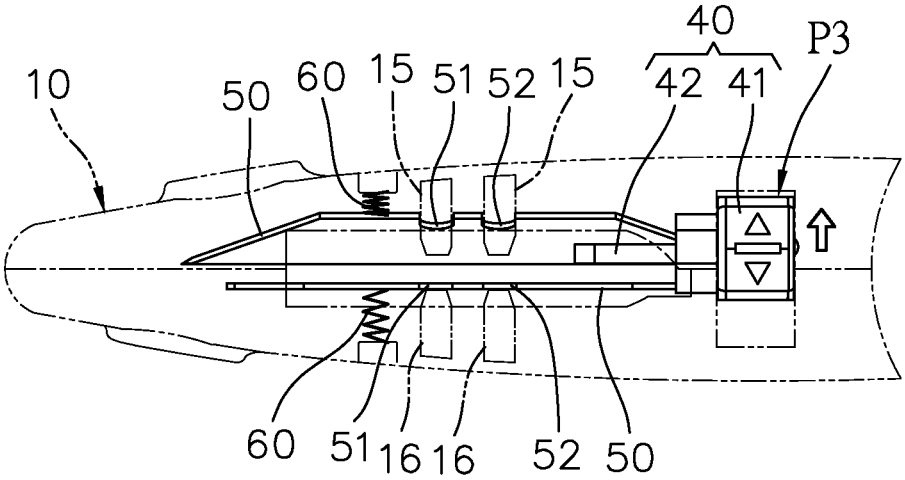
FIG. 10A is a schematic partial top plan view showing a different type of a pair of restoring elements of the present invention.
Figure 10B:
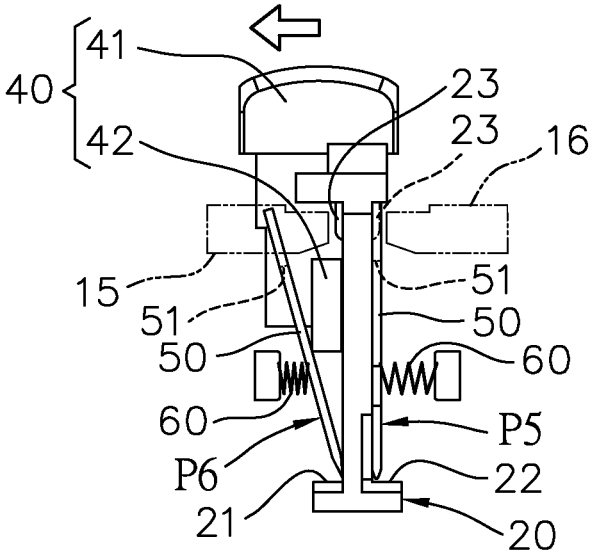
FIG. 10B is a schematic partial front elevatinoal view of FIG. 10A.

Referring to FIGS. 10A and 10B, the pair of restoring elements 60 can also be resilient elements (such as springs), and are respectively disposed at the two opposite sides of the housing 10 with respect to the first and second blade compartments 21, 22. By means of resilient force of the resilient elements 60, any of the blades 50 which is not pushed by the follower portion 42 can remain in the operative position thereof so as to achieve automatic restoration function after blade switch.

Figure 11:
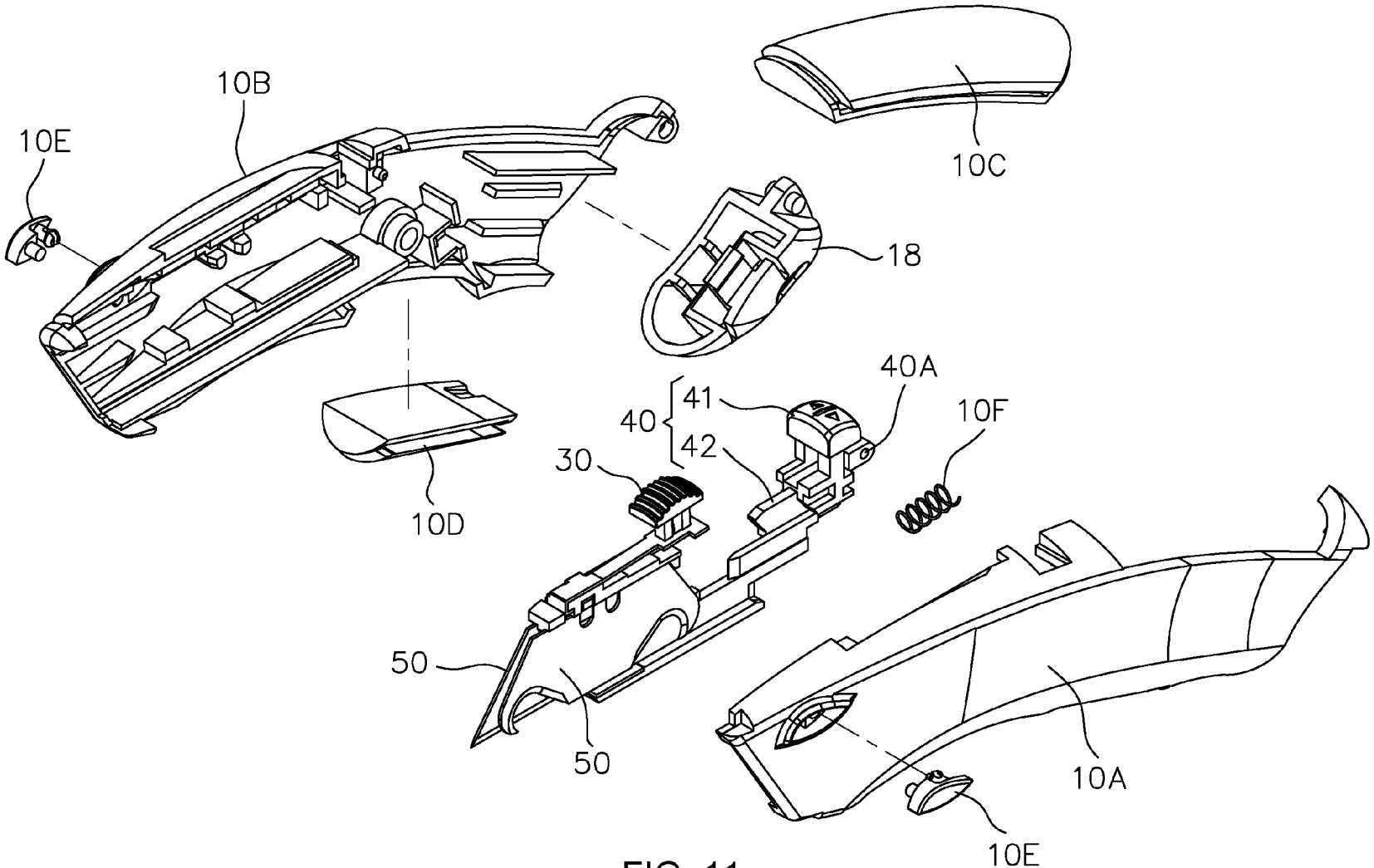
FIG. 11 is a schematic exploded view of the blade-switchable utility knife of the present invention showing a housing thereof in detail.

Referring to FIG. 11 schematically showing an exploded perspective view of the housing 10, the housing 10 comprises a right casing 10A, a left casing 10B, a top cover 10C, a bottom cover 10D, two pushing elements 10E, a resilient element 10F, and the movable cover 18. The resilient element 10F utilizes resilient force thereof to maintain the movable cover 18 in a position to close the storage space 17. Furthermore, the switch actuator 40 comprises an auxiliary element 40A to facilitate moving of the switch actuator 40 while switching.

Figure 12:
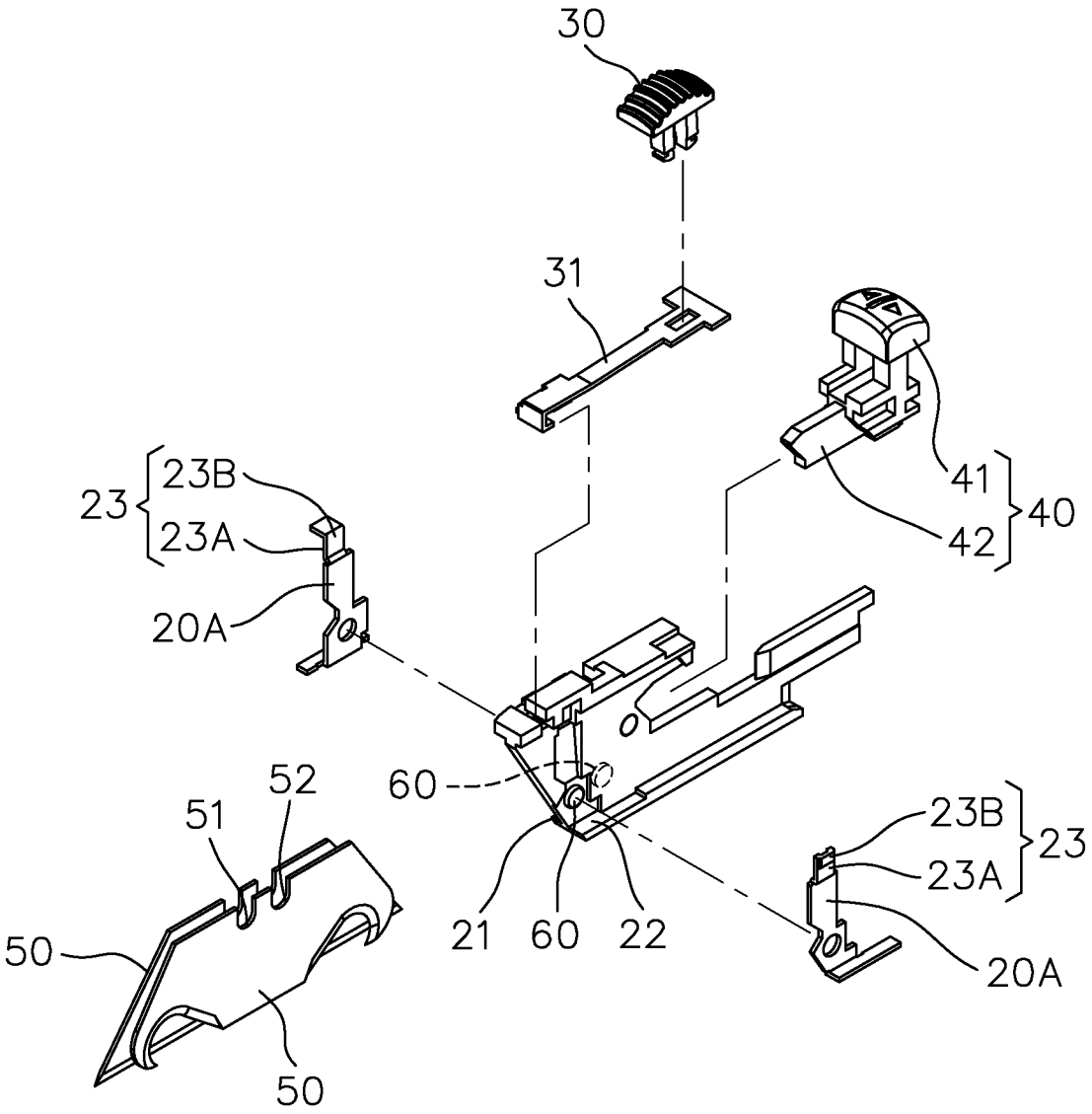
FIG. 12 is a schematic exploded view showing partial components of the blade-switchable utility knife of the present invention without the housing.

Referring to FIG. 12 schematically showing an exploded view of the blade slider 20, the slide actuator 30, the switch actuator 40, and the restoring elements 60, the blade slider 20 comprises two fixing resilient plates 20A fixed to the first and second blade compartments 21, 22, respectively. The fixing resilient plates 20A extend to form the fixing bulges 23. The slide actuator 30 has a fixing buckle 31 for buckling the slide actuator 30 with the blade slider 20. The restoring elements 60 are mounted to the fixed resilient plates 20A, respectively.

Furthermore, as shown in FIGS. 11 and 12, each of the fixing bulges 23 comprises an engaging part 23A and a releasing part 23B. The engaging parts 23A are used to engage with the first concave portions 51 of the blade 50s, and the releasing parts 23B correspond to pushing positions of the pushing elements 10E. When the pushing elements 10E are pressed to push the releasing parts 23B, the fixed resilient plates 20A accordingly bend toward a middle of the blade slider 20 so as to disengage corresponding first concave portions 51 of the blades 50 from the fixing bulge 23, and thus to dismantle the blades 50 for blade replacement or change of cutting blade ends (i.e., changing blade orientation of the dismantled blades 50 and assembling the blades 50 back to the utility knife via engagement between the second concave portion 52 and the fixing bulge 23, and continuing cutting by use of the other cutting blade end of the blades 50).

Accordingly, the present invention has advantages and effects as follows:

[1] Quick switch of blades for use: Conventional utility knifes are equipped with only one blade for use. When the blade becomes worn out and dull or different blades are in need, it is necessary to detach and replace the original blade and is very inconvenient for use. In contradistinction, the blade-switchable utility knife of the present invention is capable of being equipped with two blades, and the blades 50 can be selectively switched by a switch actuator 40 based on requirements. Accordingly, the present invention has advantages of ability to switch blades.

[2] Convenient carrying: Conventionally, when continuously and alternately using different types of blades is necessary for particular working content, multiple utility knifes will generally be prepared to perform such working content. However, such way causes problems of inconvenient carrying and cost consumption, etc. In contradistinction, the present invention utilizes blade switch to alternately use different blades based on different working contents. It is no need to carry two utility knifes and thus the present invention has advantages of convenient carrying.

While the present invention is demonstrated herein with reference to the preferred embodiments, it is to be understood that the foregoing embodiments may be slightly modified or changed without departing from the spirit and scope of the present invention.

What is claimed is:

1. A blade-switchable utility knife, comprising:

a housing defining an internal space therein, an opening, a sliding slot, a switch groove, a pair of first limit portions and a pair of second limit portions;

a blade slider received in the internal space of the housing to be slidably movable backwards and forwards within the internal space and to move to at least a blade retraction position and a blade protrusion position, the blade slider comprising a first blade compartment and a second blade compartment, a fixing bulge formed in each of the first and second blade compartments;

a slide actuator fixedly disposed on the blade slider, and installed and slidably movable in the sliding slot;

a switch actuator slidably installed in the switch groove and comprising a push portion and a follower portion, the push portion capable of being pushed to at least a first switch position and a second switch position;

a pair of blades respectively disposed in the first and second blade compartments, each blade of the pair of blades comprising a first concave portion and a second concave portion and being capable of being placed in an operative position and a non-operative position; and a pair of restoring elements used to respectively restore the pair of blades back to the operative positions thereof;

wherein when the push portion of the switch actuator is located in the first switch position, the follower portion pushes against the blade disposed in the first blade compartment to move to the non-operative position thereof so as to allow the first and second concave portions of the blade in the first blade compartment to respectively engage with the pair of first limit portions, and the blade disposed in the second blade compartment remains in the operative position thereof with the first concave portion thereof engaging with the fixing bulge of the second blade compartment whereby the blade slider is capable of advancing forward from the blade retraction position to the blade protrusion position by pushing the slide actuator so as to simultaneously move the blade in the second blade compartment extending out of the opening, and when the push portion of the switch actuator is located in the second switch position, the follower portion pushes against the blade disposed in the second blade compartment to the non-operative position thereof so as to allow the first and second concave portions of the blade in the second blade compartment to respectively engage with the pair of second limit portions, and the blade in the first blade compartment remains in the operative position thereof with the first concave portion thereof engaging with the fixing bulge of the first blade compartment whereby the blade slider is capable of advancing forward from the blade retraction position to the blade protrusion position by pushing the slide actuator so as to simultaneously move the blade in the first blade compartment extending out of the opening.

2. The blade-switchable utility knife of claim 1, wherein the housing further comprises a storage space and a movable cover, the storage space is used for storing blades therein, and the movable cover is disposed at an opening of the storage space for opening or closing the storage space.

3. The blade-switchable utility knife of claim 1, wherein the pair of restoring elements are magnetic.

4. The blade-switchable utility knife of claim 1, wherein the pair of restoring elements are resilient.

* * * * *